US006067806A

United States Patent [19]

Park

[11] Patent Number: 6,067,806

[45] Date of Patent: May 30, 2000

[54] APPARATUS AND METHOD FOR CONTROLLING AUTOMATIC ICE MACHINE

[75] Inventor: Hyung Nam Park, Incheon, Rep. of Korea

[73] Assignee: Daewoo Electronics Co., Ltd., Seoul, Rep. of Korea

[21] Appl. No.: 09/261,509

[22] Filed: Mar. 3, 1999

[30] Foreign Application Priority Data

Aug. 31, 1998 [KR] Rep. of Korea ..... 98-35728

[51] Int. Cl.[7] ..... F25C 1/12

[52] U.S. Cl. ..... 62/137; 62/137

[58] Field of Search ..... 62/71, 72, 135, 62/137, 353

[56] References Cited

U.S. PATENT DOCUMENTS 5,163,300 11/1992 Kato et al. ..... 62/135
5,560,211 10/1996 Parker ..... 62/137
5,675,975 10/1997 Lee ..... 62/72
5,768,899 6/1998 Lee et al. ..... 62/353
5,881,563 11/1992 Lee et al. ..... 62/71

*Primary Examiner*—William E. Tapolcal
*Attorney, Agent, or Firm*—Pillsbury Madison & Sutro LLP

[57] ABSTRACT

An apparatus and method for controlling of a refrigerator automatic ice machine is disclosed. A first detection plate is installed on another end of the rotation shaft of the ice transfer motor, for detecting an initial position of an ice tray, the ice-fullness of the ice box and rotation angle of the ice transfer motor. A second detection plate is installed on one end of the ice-fullness lever, for detecting the ice-fullness of the ice box. A pulse generator generates pulse trains by the combination of movements of the first and second detection plates according to the driving of the ice transfer motor. A controller generates a forward or a reverse rotation control signal according to the pulse trains provided from the pulse generator and provides the forward or the reverse rotation control signal to the motor driver. According to the construction of the above, the ice fullness of an ice box of an automatic ice machine can be exactly sensed and errors in sensing the ice-fullness and driving an ice transfer motor can be prevented.

10 Claims, 7 Drawing Sheets

APPARATUS AND METHOD FOR CONTROLLING AUTOMATIC ICE MACHINE

BACKGROUND OF THE INVENTION

1. Field of the Invention

The present invention relates to an apparatus and method for controlling an automatic ice machine for a refrigerator, and more particularly, to an apparatus and method for controlling an automatic ice machine, in which the ice-fullness detection of an ice box and the driving of the ice transfer motor can be performed, according to a detection signal generated from a photosensor.

2. Description of the Related Art

In general, in an automatic ice machine, a series of operations are repeatedly controlled such that water is supplied to an ice tray disposed in a freezer compartment, the ice tray is rotated downwardly by driving an ice transfer motor if freezing is sensed, the ice formed in the ice tray is transferred to an ice box disposed under the ice tray and is accumulated therein, and then an ice forming operation is performed again.

At an initial stage of the ice transfer operation, it is detected whether the ice box is full of ice to determine whether the ice transfer operation must be performed or not. If it is detected that the ice box is not full of ice, the ice transfer operation is performed. Here, the ice tray is rotated askew by the driving of the ice transfer motor so that the ice is transferred and then the ice tray is restored to its original position. The detection of ice-fullness of the ice box and the rotation operation of the ice transfer motor are controlled according to the detection results by each sensor.

The sensor is constituted by a switch operating mechanically. However, since the freezer compartment of the refrigerator is always in a low temperature and high humidity condition, the sensor may be frozen, and an error may be generated in forming or transferring ice, accordingly.

FIG. 1 is a schematic diagram of the above-described automatic ice machine for a refrigerator. The automatic ice machine comprises an ice vessel 120, an ice sensor 121 installed on the bottom surface of the ice vessel 120 for detecting the temperature of the ice vessel 120, a controller 110 having an ice transfer motor 111 for rotating the ice vessel 120 askew at a predetermined angle, a horizontaility sensing switch 115 for sensing the horizontality of the ice vessel 120, a polarity switch 112 for switching the rotation direction of the ice transfer motor 111 for restoring the ice vessel 120 positioned askew into its original position (horizontality) and an ice-fullness sensing switch 113 for sensing fullness of ice 131 accumulated in an ice box 130 by means of a sensing rod 114, a water tank sensing switch 143 for sensing, presence or absence of a water tank 140, a water storage chamber 142 for storing a predetermined amount of water in the water tank 140, and a pump motor 141 for pumping out water from the water storage chamber 142 to the ice vessel 120 through a water supply hose 150.

An ice transfer controlling method of the automatic ice machine having the aforementioned configuration will be described with reference to FIG. 2. Referring to FIG. 2, in step 201, it is determined whether freezing time of 2 or 3 hours is elapsed. If freezing time of 2 or 3 hours is elapsed, in step 202, it is determined whether freezing temperature is less than −9° C. If freezing is detected by steps 201 and 202, the ice transfer motor 111 is driven to transfer ice to the ice box 130 (step 203).

Here, the ice vessel 120 is rotated in an ice transfer direction so that a latching portion (not shown) provided in the ice vessel 120 is latched by a latch (not shown) formed on a support structure (not shown) and is positioned askew at a predetermined angle to then be rotated, so that the ice generated in the ice vessel 120 falls down to the ice box 130 at a predetermined point, as shown in FIG. 1. Then, the polarity switch 112 is turned on so that the ice transfer motor 111 is rotated reversely and the ice vessel 120 is restored to its original position.

If the ice transfer operation is completed in the above-described manner, the controller 110 generates a control signal to the ice-fullness detection switch 113 to operate the sensing rod 114 for sensing whether the ice box 130 is full of the ice 131, and it is determined whether the ice box 130 is full of the ice 131 (step 204). If the ice-fullness state is detected, all operations are suspended until the ice-fullness state is resolved (step 205).

According to the conventional apparatus for controlling an automatic ice machine as the above, the polarity switch 112 for sensing a signal for controlling the rotation angle of the ice transfer motor 111 and the ice-fullness sensing switch 113 for sensing ice-fullness of the ice box 130 may be frozen, which results in malfunction. Also, the conventional apparatus for controlling an automatic ice machine requires many parts, which increases the manufacturing cost and makes the structure complex.

SUMMARY OF THE INVENTION

To solve the above problems, it is an object of the present invention to provide an apparatus and method for controlling an automatic ice machine, in which the ice-fullness of an ice box and the rotation angle of the ice transfer motor can be exactly detected, by the width and number of pulses generated by a photosensor having a light emitting device and a light receiving device located at both sides of two pulse detection plates.

To achieve the above object, there is provided an apparatus for controlling an automatic ice machine comprising: an ice transfer motor; a motor driver for driving the ice transfer motor; an ice-fullness lever connected with one end of a rotation shaft of the ice transfer motor, for sensing ice-fullness of an ice box; a first detection plate installed on another end of the rotation shaft of the ice transfer motor, for detecting an initial position of an ice tray, the ice-fullness of the ice box and rotation angles of the ice transfer motor; a second detection plate installed on one end of the ice-fullness lever, for detecting the ice-fullness of the ice box; a first pulse generator for generating pulse trains by the combination of movements of the first and second detection plates according to the driving of the ice transfer motor; and a controller for generating a forward or a reverse rotation control signal according to the pulse trains provided from the first pulse generator and providing the forward or the reverse rotation control signal to the motor driver.

To achieve the above object, there is provided a method for controlling an automatic ice machine having a first detection plate installed on an end of the rotation shaft of an ice transfer motor, having a first slit for detecting an initial position of an ice tray, a second slit for ice-fullness of an ice box and a plurality of third slits for detecting rotation angles of the ice transfer motor, sequentially formed at the peripheral portion of the ice transfer motor, a second detection plate installed on an end of an ice-fullness lever having a plurality of fourth slits for detecting the ice-fullness of the ice box, and a pulse generator for generating pulse trains by the combination of movements of the first and second detection plates according to the driving of the ice transfer motor, comprising the steps of: a) determining whether an ice box is full of ice from the width and number of the pulse trains provided from the pulse generator by means of the second and fourth slits while rotating forwardly the ice transfer motor; b) rotating reversely the ice transfer motor until the initial position of the ice tray is detected from the width and number of the pulse trains provided from the pulse generator by means of the first and second slits, if ice-fullness of the ice box is not detected in the step a); c) rotating forwardly the ice transfer motor until completion of ice transfer operation is detected from the width and number of the pulse trains provided from the pulse generator by means of the third slits, if ice-fullness of the ice box is detected in the step a); and d) rotating reversely the ice transfer motor until the initial position of the ice tray is detected from the width and number of the pulse trains provided from the pulse generator by means of the first to fourth slits, if the completion of the ice transfer operation is detected in the step c).

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Hereinbelow, an apparatus and method for controlling the automatic ice machine according to a preferred embodiment of the present invention will be described with reference to the accompanying drawings.

Figure 1:
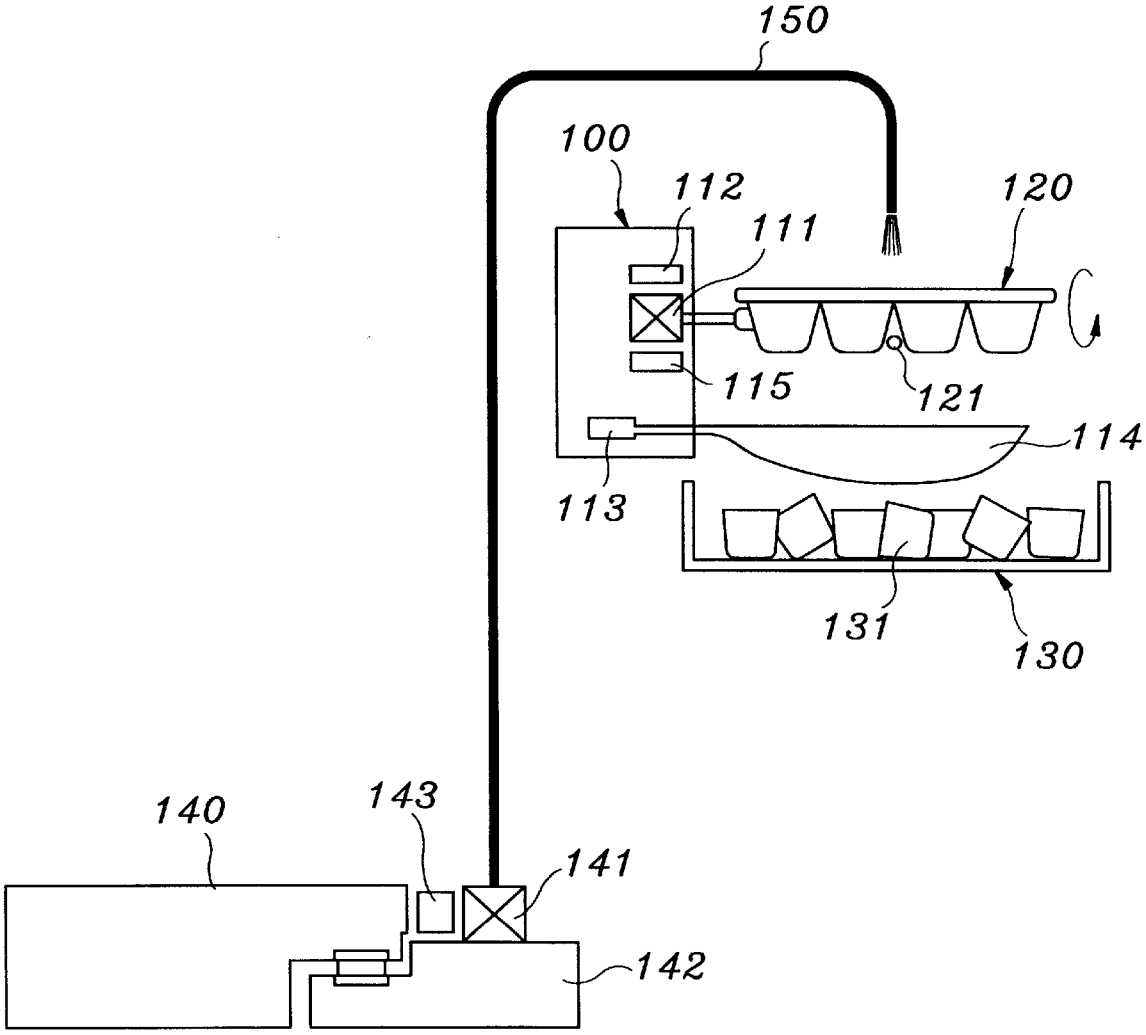
FIG. 1 (PRIOR ART)
FIG. 1 is a schematic diagram of a conventional automatic ice machine for a refrigerator.
Figure 2:
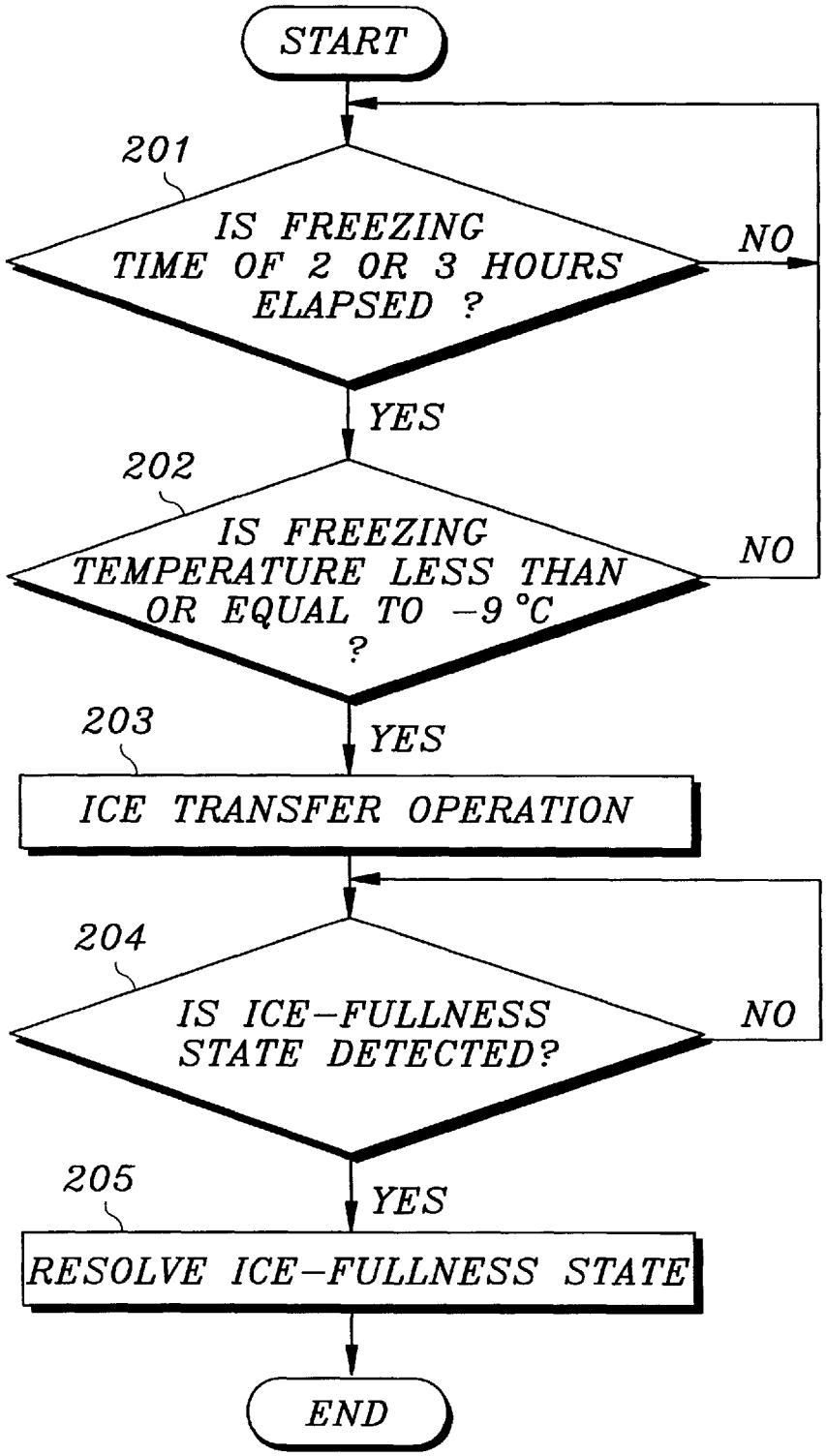
FIG. 2 (PRIOR ART)
FIG. 2 is a flowchart illustrating an ice transfer controlling method of the automatic ice machine shown in FIG. 1.
Figure 3A:
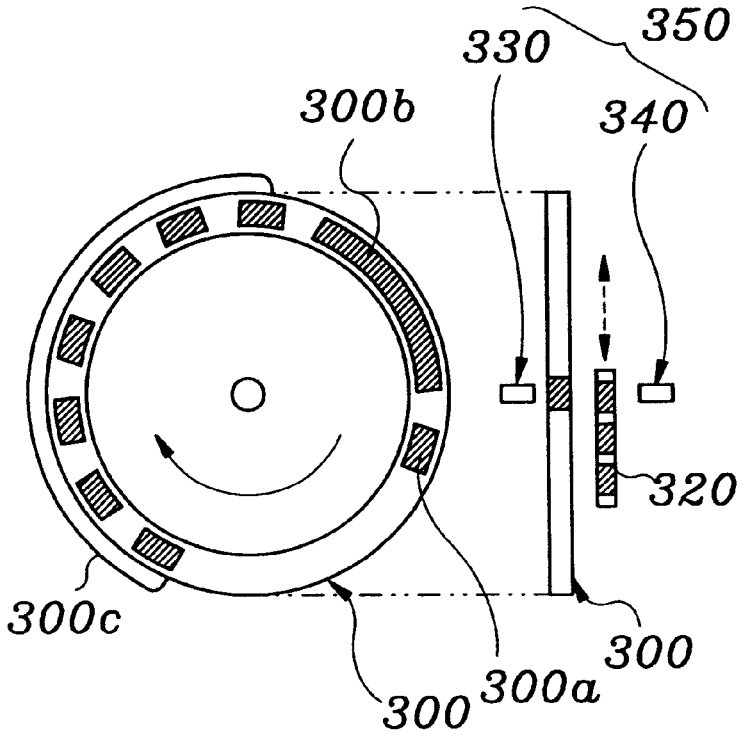
FIGS. 3A and 3B are schematic diagrams of first and second detection plates for ice-fullness detection of an ice box and rotation angle detection of an ice transfer motor, according to the present invention.
Figure 3B:
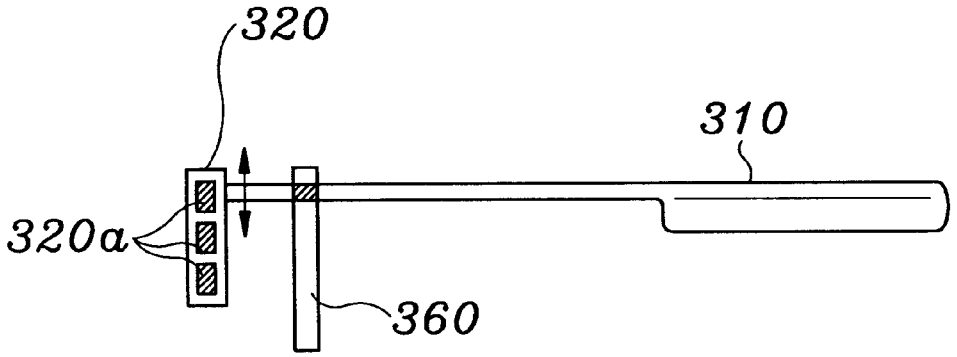

FIGS. 3A and 3B are a sectional view and a side view of first and second detection plates for ice-fullness detection and motor rotation angle detection, according to the present invention.

Referring to FIG. 3A, a first and a second detection plates 300 and 320 are located between a light emitting device 330 and a light receiving device 340 forming a photosensor 350. The circular plate-shaped first detection plate 300 is installed at one side of the rotation shaft of an ice transfer motor (not shown) and is rotated therewith, thereby detecting rotation angles of the ice transfer motor. In the peripheral portion of the first detection plate 300, a slit 300*a* for detecting an initial horizontal position of an ice tray (not shown), a slit 300*b* to be set as a period for detecting ice-full Less, having a length corresponding to the transit section of slits 320*a* of the second detection plate 320, and a plurality of slits 300*c* for detecting the rotation angles of the ice transfer motor, are circumferentially spaced at a predetermined distance. The number of the slits 300*c* are seven, for example, and are installed close to one another so as to generate pulse trains having a width of 500 ms, for example, respectively, detected by the photosensor 350.

Referring to FIG. 3B, there is provided an ice-fullness lever 310 vertically moving according to rotation of a cam 360 installed on a rotation shalt of the ice transfer motor. The rod-shaped second detection plate 320 is installed at one end of the ice-fullness lever 310 for detecting ice-fullness of an ice box (not shown), having slits 320*a* formed vertically. The number of the slits 320*a* are three, for example, and are installed close to one another so as to generate pulse trains having a width of 50 ms, for example, respectively, detected by the photosensor 350.

The slits 320*a* of the second detection plate 320, and the slits 300*a*, 300*a* and 300*c* of the first detection plate 300 are disposed so as to transit the same vertical plane. Also, the photosensor 350 comprised of the light emitting device 330 and the light receiving device 340 is installed on the vertical plane to then generate pulse trains when the respective slits 320*a*, 300*a*, 300*a* and 300*c* transit the vertical plane.

Figure 4:
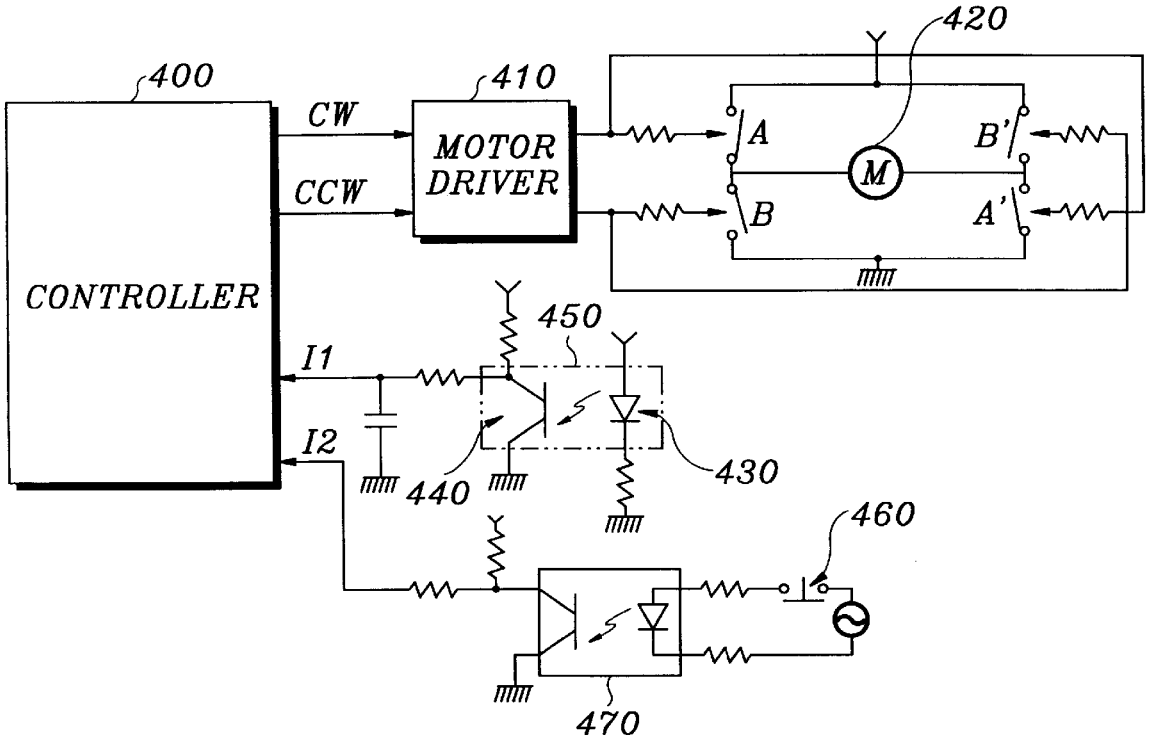
FIG. 4 is a block diagram of an apparatus for controlling the automatic ice machine according to the present invention.

FIG. 4 is a block diagram of an apparatus for controlling the automatic ice machine according to the present invention. The apparatus for controlling the automatic ice machine comprises a controller 400, a motor driver 410, a plurality of switches A, A', B and B', an ice transfer motor 420, a first photosensor 450 having a light emitting device 430 and a light receiving device 440, a door switch 460 and a second photosensor 470.

Referring to FIG. 4, the controller 400 receives a pulse signal provided from the first photosensor 450 and provides a clockwise (CW) control signal or a counter-clockwise (CCW) control signal to the motor driver 410 according to widths and numbers of pulse signal provided from the first photosensor 450. Also, the controller 400 receives a pulse signal provided from the second photosensor 470 and provides a clockwise (CW) control signal to the motor driver 410 according to detection results of the second photosensor 470.

The motor driver 410 turns on switches A and A' according to the CW control signal, which drives the ice transfer motor 420 in the forward direction and turns on switches B and B' according to the CCW control signal, which drives the. ice transfer motor 420 in the reverse direction.

The first photosensor 450 generates pulse trains by the combination of movements of the first and second detection plates 300 and 320 according to the driving of the ice transfer motor 420 and provides the same to a first input port I1 of the controller 400. Here, the light emitting device 430 of the first photosensor 450 maintains turn-on state during the driving period of the ice transfer motor 420.

The second photosensor 470 generates a pulse signal by on-off operations of the door switch 460 and provides the same to a second input port I2 of the controller 400.

In summary, when the ice-fullness lever 310 is moved downward vertically at an initial driving stage of the ice transfer motor 420, the second detection plate 320 moves upward vertically between the light emitting device 330 or 430 and the light receiving device 340 or 440. Then, three pulses having a pulse width of 50 ms by the slits 320*a* as described above, are generated from the light receiving device, 340 or 440. When the second detection plate 320 is moved, the first detection plate 300 also rotates. At this time, while the slits 320*a* transits the first photosensor 350 or 450, the slit 300*b* is made to transit. Accordingly, the movement state of the ice-fullness lever 310 can be detected, irrespective of the operation of the first detection plate 300. If three pulses caused by the slits 320*a* are not detected during such operations, the controller 400 determines that the ice box is full of ice and stops performing further ice transfer operations.

Next, the detection of the rotation angle of the ice transfer motor 420 will be described.

The rotation angle of the ice transfer motor 420 is regularly detected after the transit of the slit 300*b* for ice-fullness detected section. As illustrated, if it is detected that 7 slits 300*c* all transit by the operation of the first photosensor 350 or 450, it is determined that the ice transfer operation is completed, and the ice transfer motor 420 is driven reversely to restore the ice tray into its original position. Here, the completion timing of the reverse rotation of the ice transfer motor 420 is determined to be the detection timing of all pulses generated by the slits 300*c*, 300*b* and 300*a*, that is, in a reverse order to that of the above-described ice transfer operation.

The method for controlling the above-described automatic ice machine according to the present invention will be described in more detail with reference to FIGS. 5A, 5B and 6.

Figure 5A:
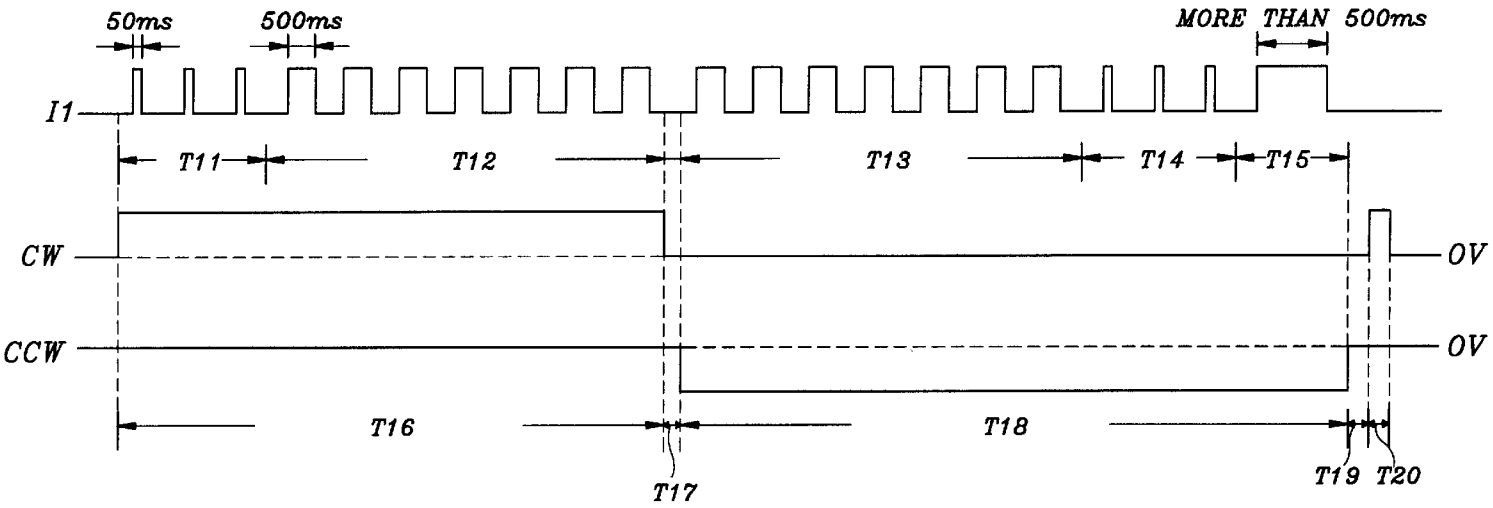
FIGS. 5A and 5B are waveforms representing input and output signals of the controller at normal and ice-fullness states, respectively, in FIG. 4.
Figure 5B:
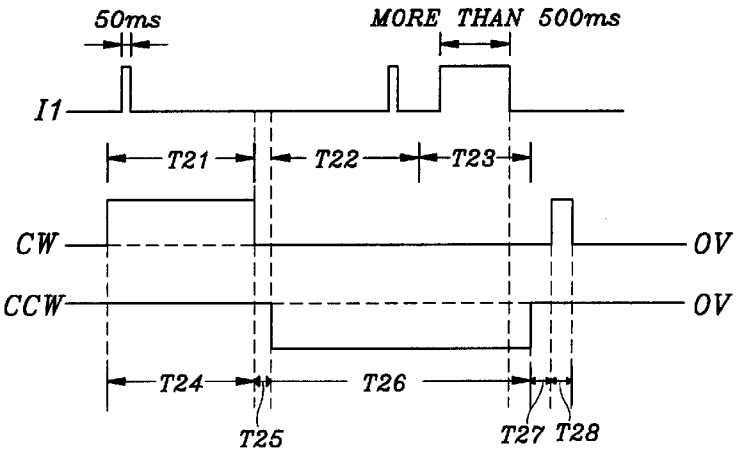

FIGS. 5A and 5B are waveforms representing input and output signals, I1, CW and CCW of the controller 400 at normal state and ice-fullness state, respectively, in FIG. 4. In the I1 signal of FIG. 5A, T11 and T14 denote pulse signals generated by the slits 300*b* and 320*a*, T12 and T13 denote pulse signals generated by the slits 300*c*, and T15 denotes pulse signal generated by the slit 300*a*. In the CW and CCW control signals of FIG. 5A, T16 and T20 denote a forward rotation period of the ice transfer motor 420, T17 and T19 denote a stop period of the ice transfer motor 420, and T18 denotes a reverse rotation period of the ice transfer motor 420. In the I1 signal of FIG. 5B, T21 and T22 denote pulse signals generated by the slits 300*b* and 320*a*, and T23 denotes a pulse signal generated by the slits 300*a*. In the CW and CCW control signals of FIG. 5B, T24 and T28 denote a forward rotation period of the ice transfer motor 420, T25 and T27 denote a stop period of the ice transfer motor 420, and T26 denotes a reverse rotation period of the ice transfer motor 420.

Figure 6A:
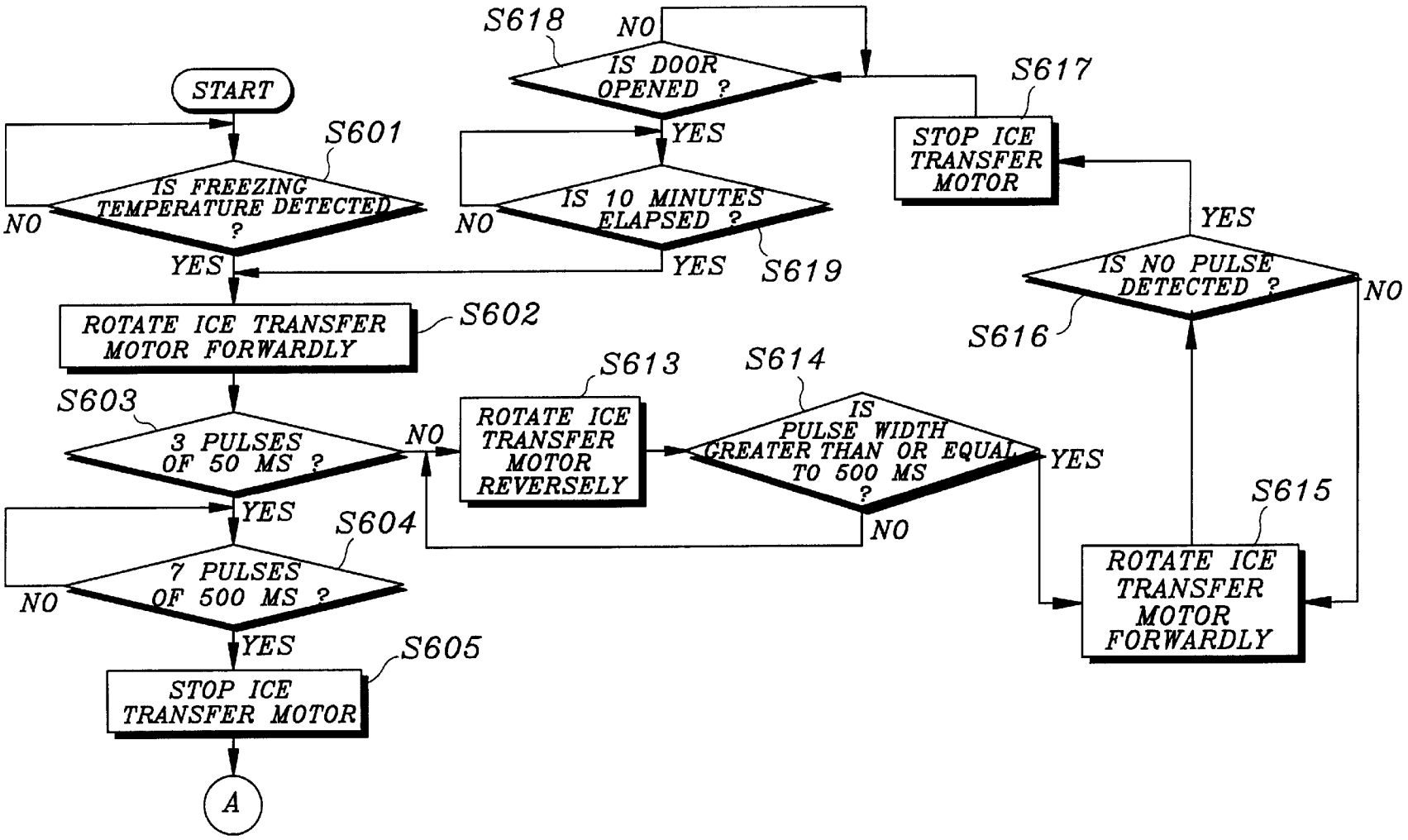
FIG. 6 is a flowchart illustrating a method for controlling the automatic ice machine according to the present invention.
Figure 6B:
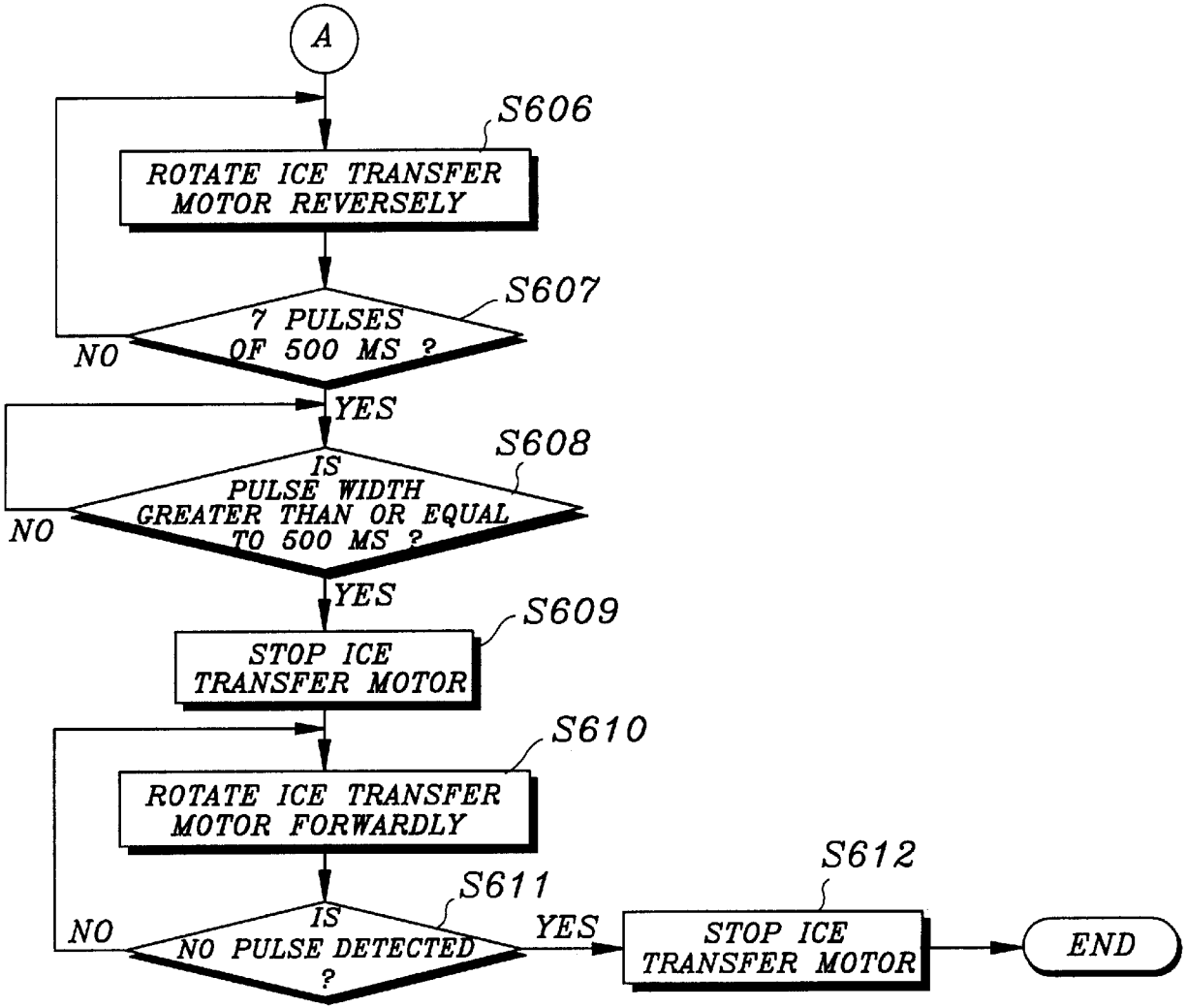

FIG. 6 is a flowchart illustrating a method for controlling the automatic ice machine according to the present invention.

In step S601, if the temperature of the ice vessel is detected to be a freezing temperature after water is supplied to the ice vessel, the ice transfer motor 420 is forwardly rotated, in step S602 as shown in T16 of FIG. 5A or T24 of FIG. 5B. According to the forward rotation of the ice transfer motor 420, the first detection plate 300 rotates forwardly and the second detection plate 320 moves upward vertically. According to the combination of movement of the slits 320*a* and 300*b* between the light emitting device 330 or 430 and the light receiving device 340 or 440 installed on both sides of the first and second detection plates 300 and 320, pulses are generated by the light receiving device 340 or 440, which is then detected by the controller 400.

In step S603, it is determined whether three pulses having a pulse width of 50 ms by the slits 300*b* and 320*a* are detected. If three pulses having a pulse width of 50 ms are all detected as shown in T11 of FIG. 5A, it is determined that the ice box is not full of ice to thus perform the ice transfer operation continuously.

In step S604, it is detected whether 7 pulses having a pulse width of 500 ms are detected according to the transit of the slits 300*c*. If 7 pulses having a pulse width of 500 ms are all detected as shown in T12 of FIG.5A, it is detected that the ice transfer operation is completed to then stop rotation of the ice transfer motor 420, in step S605, and then the ice transfer motor 420 is reversely rotated in step S606 as shown in T18 of FIG. 5A.

According to the reverse rotation of the ice transfer motor 420, the first detection plate 300 rotates reversely. If 7 pulses having a pulse width of 500 ms are detected in step S607, as shown in T13 of FIG.5A and a pulse signal having a width greater than 500 ms, that is, a pulse signal generated by the slit 300*a*, ares detected in step S608, as shown in T15 of FIG.5A, in the reverse order to the above-described detection order, the ice tray is restored into its original position and it is determined that the horizontality is maintained to thus stop driving the ice transfer motor 420 (step S609).

Subsequently, the ice transfer motor 420 is forwardly rotated again to determine whether pulses are generated or not in step S610, as shown in T20 of FIG. 5A. If it is determined that no pulse is generated in step S611, the driving of the ice transfer motor 420 is stopped and the control operation of the automatic ice machine is terminated in step S612.

On the other hand, in step S603 for determining detection of three pulses having a pulse width of 50 ms during the forward rotation of the ice transfer motor 420, if three pulses having a pulse width of 50 ms are not detected as shown in T21 of FIG. 5B, it is determined that the ice box is full of ice to thus rotate the ice transfer motor 420 reversely, thereby stopping performing further ice transfer operations and returning the ice tray into its original position. For this purpose, in step S613, the ice transfer motor 420 is rotated reversely as shown in as shown in T26 of FIG. 5B. In step S614, it is determined whether a pulse signal having a width greater than 500 ms, that is, a pulse signal generated by the slit 300*a*, are detected. If the pulse generated by the slit 300*a* are detected as shown in T23 of FIG. 5B, the ice transfer motor 420 is rotated forwardly in step S615, as shown in T28 of FIG. 5B.

In step S616, it is determined whether no pulse is detected during the forward rotation of the ice transfer motor 420. If no pulse is detected during the forward rotation of the ice transfer motor 420, the driving of the ice transfer motor 420 is completely stopped in step S617.

In step S618, it is determined whether the door of the freezer compartment is opened or not, and then, in step S619, it is determined whether 10 minutes, for example has been elapsed if the door is opened. If 10 minutes has been elapsed in step S619, the operations following the step S602 are performed to execute the ice transfer operation.

As described above, according to the present invention, ice-fullness of an ice box of an automatic ice machine can be exactly sensed using a photosensor and two detection plates. Thus, errors in sensing the ice-fullness using conventional mechanical means and driving an ice transfer motor can be prevented. As a result, product reliability can be enhanced.

Although the present invention has been described in detail herein with reference to illustrative embodiments, the invention is not limited thereto and various changes and modifications may be effected by one skilled in the art within the scope of the invention in consideration of the detailed description of the invention and the accompanying drawings.

What is claimed is:

1. An apparatus for controlling of a refrigerator automatic ice machine having an ice transfer motor, a motor driver for driving the ice transfer motor and an ice-fullness lever connected with one end of a rotation shaft of the ice transfer motor, for sensing ice-fullness of an ice box, comprising:

a first detection plate installed on another end of the rotation shaft of the ice transfer motor, for detecting an initial position of an ice tray, the ice-fullness of the ice box and rotation angles of the ice transfer motor;

a second detection plate installed on one end of the ice-fullness lever, for detecting the ice-fullness of the ice box;

a first pulse generator for generating pulse trains by the combination of movements of said first and second detection plates according to the driving of the ice transfer motor; and a controller for generating a forward or a reverse rotation control signal according to the pulse trains provided from said first pulse generator and providing the forward or the reverse rotation control signal to the motor driver.

2. The apparatus for controlling of a refrigerator automatic ice machine according to claim 1, wherein said first detection plate has a circular plate shape and includes a first slit for detecting the initial position of the ice tray, a second slit to be set as a period for detecting the ice-fullness of the ice box and a plurality of third slits for detecting rotation angles of the ice transfer motor, sequentially formed at the peripheral portion of the ice transfer motor.

3. The apparatus for controlling of a refrigerator automatic ice machine according to claim 2, wherein said second detection plate has a rod shape and includes a plurality of fourth slits corresponding to the length of the second slit.

4. The apparatus for controlling of a refrigerator automatic ice machine according to claim 1, wherein said first detection plate rotates in the same direction as the movement of the ice transfer motor, whereas said second detection plate moves in the reverse direction to the movement of the ice-fullness lever.

5. The apparatus for controlling of a refrigerator automatic ice machine according to claim 1, wherein said first pulse generator is implemented by a photosensor having a light emitting device and a light receiving device located at both sides of said first and second detection plates, respectively.

6. The apparatus for controlling of a refrigerator automatic ice machine according to claim 1 further comprising a second pulse generator for generating a pulse signal by on-off operations of a door switch of a freezer compartment to be provided to said controller.

7. The apparatus for controlling of a refrigerator automatic ice machine according to claim 6, wherein said second pulse generator is implemented by a photosensor having a light emitting device and a light receiving device connected to said door switch and controller, respectively.

8. A method for controlling of a refrigerator automatic ice machine having two detection plates moving in connection with an ice transfer motor, and a pulse generator having a light emitting device and a light receiving device located at both sides of the two detection plates, comprising the steps of:

a) determining whether an ice box is full of ice from the width and number of pulse trains provided from the pulse generator while rotating forwardly the ice transfer motor;

b) rotating reversely the ice transfer motor until an initial position of an ice tray is detected from the width and number of the pulse trains provided from the pulse generator, if ice-fullness of the ice box is not detected in said step a);

c) rotating forwardly the ice transfer motor until completion of ice transfer operation is detected from the width and number of the pulse trains provided from the pulse generator, if ice-fullness of the ice box is detected in said step a); and d) rotating reversely the ice transfer motor until the initial position of the ice tray is detected from the width and number of the pulse trains provided from the pulse generator, if the completion of the ice transfer operation is detected in said step c).

9. A method for controlling of a refrigerator automatic ice machine having a first detection plate installed on an end of a rotation shaft of an ice transfer motor, having a first slit for detecting an initial position of an ice tray, a second slit for ice-fullness of an ice box and a plurality of third slits for detecting rotation angles of the ice transfer motor, sequentially formed at the peripheral portion of the ice transfer motor, a second detection plate installed on an end of an ice-fullness lever having a plurality of fourth slits for detecting the ice-fullness of the ice box, and a pulse generator for generating pulse trains by the combination of movements of said first and second detection plates according to the driving of the ice transfer motor, comprising the steps of:

a) determining whether an ice box is full of ice from the width and number of pulse trains provided from the pulse generator by means of the second and fourth slits while rotating forwardly the ice transfer motor;

b) rotating reversely the ice transfer motor until an initial position of an ice tray is detected from the width and number of the pulse trains provided from the pulse generator by means of the first and second slits, if ice-fullness of the ice box is not detected in said step a);

c) rotating forwardly the ice transfer motor until completion of ice transfer operation is detected from the width and number of the pulse trains provided from the pulse generator by means of the third slits, if ice-fullness of the ice box is detected in said step a); and d) rotating reversely the ice transfer motor until the initial position of the ice tray is detected from the width and number of the pulse trains provided from the pulse generator by means of the first to fourth slits, if the completion of the ice transfer operation is detected in said step c).

10. The method for controlling of a refrigerator automatic ice machine according to claim 9 further comprising the steps of:

e) stopping the driving of the ice transfer motor after rotating forwardly the ice transfer motor, if the initial position of the ice tray is detected in said step b); and f) performing repeatedly said steps a) to e), if a predetermined time is elapsed after a door of a freezer compartment is opened.

* * * * *